US008651321B2

(12) United States Patent
Fu

(10) Patent No.: US 8,651,321 B2
(45) Date of Patent: Feb. 18, 2014

(54) GUMBALL MACHINE WITH LIGHTS AND SOUND

(75) Inventor: Hoi Wai Fu, Hong Kong (HK)

(73) Assignee: Sweet N Fun, Ltd., Hong Kong (HK)

( * ) Notice: Subject to any disclaimer, the term of this patent is extended or adjusted under 35 U.S.C. 154(b) by 240 days.

(21) Appl. No.: 13/068,894

(22) Filed: May 23, 2011

(65) Prior Publication Data

US 2012/0298685 A1 Nov. 29, 2012

(51) Int. Cl.

| | |
|---|---|
| ***G07F 11/00*** | (2006.01) |
| ***A24F 15/04*** | (2006.01) |
| ***B65H 1/00*** | (2006.01) |
| ***A47F 1/04*** | (2006.01) |

(52) U.S. Cl.

USPC ..... 221/24; 221/3; 221/8; 221/133; 221/122; 221/152; 221/154; 221/210; 221/217; 221/196; 221/284; 221/119; 221/265; 221/92; 473/415

(58) Field of Classification Search

CPC ..... G07F 11/00; A24F 15/04; A47F 1/04; B65H 1/00

USPC ..... 221/3, 8, 133, 122, 152, 154, 24, 155, 221/254, 210, 217, 196, 284, 119, 265, 92; 473/415

See application file for complete search history.

(56) References Cited

U.S. PATENT DOCUMENTS

| | | | | |
|---|---|---|---|---|
| 467,676 | A | 1/1892 | Schneider | |
| 2,442,174 | A * | 5/1948 | May | 194/204 |
| 2,529,222 | A * | 11/1950 | Makibbin | 221/122 |
| 2,671,546 | A * | 3/1954 | Weiler | 194/225 |
| 2,759,632 | A * | 8/1956 | Ussery et al. | 221/199 |
| 2,772,811 | A * | 12/1956 | Schaef | 221/155 |
| 2,876,928 | A * | 3/1959 | Adams et al. | 221/122 |
| 2,880,906 | A * | 4/1959 | Probasco | 221/203 |
| 2,990,084 | A * | 6/1961 | Probasco | 221/122 |
| 3,264,478 | A * | 8/1966 | Moldovan | 250/206 |
| 4,109,825 | A * | 8/1978 | Weitzman | 221/14 |
| 4,126,366 | A * | 11/1978 | Handler et al. | 312/249.2 |
| 4,220,256 | A * | 9/1980 | Torri | 221/147 |
| 4,663,943 | A * | 5/1987 | Dyment et al. | 62/250 |
| 5,176,290 | A * | 1/1993 | Schwarzli | 221/203 |
| 5,452,822 | A * | 9/1995 | Haymond | 221/155 |
| 5,485,939 | A * | 1/1996 | Tucker | 221/86 |
| 5,783,278 | A * | 7/1998 | Nishimura et al. | 428/102 |
| 5,788,115 | A * | 8/1998 | Halliburton | 221/155 |
| 5,833,117 | A * | 11/1998 | Kovens et al. | 221/24 |
| 5,897,022 | A * | 4/1999 | Mann | 221/24 |
| 6,056,151 | A * | 5/2000 | Peery et al. | 221/24 |
| 6,211,626 | B1 | 4/2001 | Lys | |
| 6,378,724 | B1 * | 4/2002 | Chang | 221/24 |

(Continued)

*Primary Examiner* — Gene O. Crawford
*Assistant Examiner* — Rakesh Kumar
(74) *Attorney, Agent, or Firm* — Raymond Sun

(57) ABSTRACT

A gumball machine includes a gumball container that contains a plurality of gumballs, and a neck portion coupled to the gumball container. The gumball machine has an elongated transparent housing having an upper end coupled to the neck portion, and a base coupled to the lower end of the elongated housing. A speaker is positioned inside the base and is electrically coupled to a switch, a plurality of lighting elements are arranged inside the transparent housing and electrically coupled to the switch, and a power supply is housed inside the base and electrically coupled to the switch, the speaker and the lighting elements. When an actuator is actuated, the actuator turns on the switch to cause the lighting elements to flash, the speaker to broadcast sound and/or music, and a gumball to be dispensed from the gumball container.

5 Claims, 4 Drawing Sheets

(56) References Cited

U.S. PATENT DOCUMENTS

| | | | | |
|---|---|---|---|---|
| 6,485,349 | B1 | 11/2002 | Snyder | |
| 6,536,625 | B2 * | 3/2003 | Chang | 221/132 |
| 7,182,219 | B2 * | 2/2007 | Chang | 221/133 |
| 7,213,723 | B2 * | 5/2007 | Schwarzli | 221/254 |
| 7,743,942 | B1 * | 6/2010 | Chang | 221/133 |
| 7,766,145 | B1 * | 8/2010 | Chang | 193/13 |
| 2002/0109293 | A1 * | 8/2002 | Humphrey | 273/138.1 |
| 2003/0024944 | A1 * | 2/2003 | Chang | 221/119 |
| 2003/0062374 | A1 * | 4/2003 | Coleman et al. | 221/24 |
| 2003/0203762 | A1 * | 10/2003 | Ross | 473/151 |
| 2005/0279760 | A1 * | 12/2005 | Yao | 221/265 |
| 2008/0169910 | A1 * | 7/2008 | Greene et al. | 340/10.34 |
| 2008/0254846 | A1 * | 10/2008 | Magers et al. | 463/7 |
| 2012/0175381 | A1 * | 7/2012 | Fu | 221/92 |
| 2012/0298685 | A1 * | 11/2012 | Fu | 221/3 |

* cited by examiner 52
54
74
58
60
76
72
68
66
64
62
78
38
92
90
50
77
74
88
68
20
16

GUMBALL MACHINE WITH LIGHTS AND SOUND

BACKGROUND OF THE INVENTION

1. Field of the Invention

The present invention relates to gumball machines, and in particular, to a gumball machine that produces lights and sound effects when a gumball is dispensed.

2. Description of the Prior Art

Gumball machines have been popular novelty items for a long time. Children and adults alike have enjoyed dispensing a gumball from a spherical transparent container. Some gumball machines have even been provided with tracks along which the gumball can travel while being dispensed.

SUMMARY OF THE DISCLOSURE

It is an object of the present invention to provide a gumball machine that provides additional fun and novelty for the user.

In order to accomplish the objects of the present invention, the gumball machine according to the present invention includes a gumball container that contains a plurality of gumballs, and a neck portion coupled to the gumball container. The neck portion has a switch and gumball dispensing assembly that includes an actuator that is operatively coupled to the switch. The gumball machine further includes an elongated transparent housing having an upper end coupled to the neck portion, and a base coupled to the lower end of the elongated housing and having a bottom portion that is seated on a surface. A speaker is positioned inside the base and electrically coupled to the switch, a plurality of lighting elements are arranged inside the transparent housing and electrically coupled to the switch, and a power supply is housed inside the base and electrically coupled to the switch, the speaker and the lighting elements. Actuation of the actuator turns on the switch to cause the lighting elements to flash, the speaker to broadcast sound and/or music, and a gumball to be dispensed from the gumball container.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
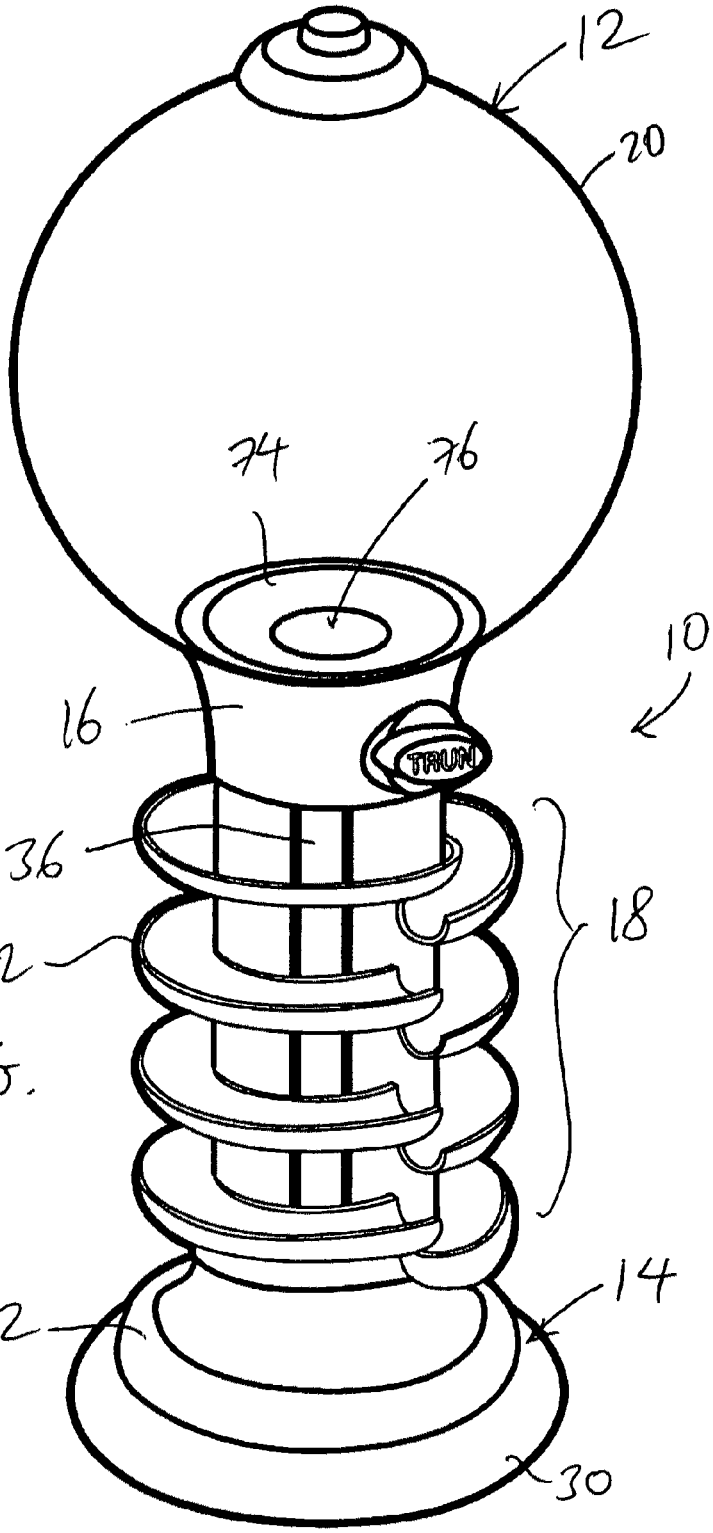
FIG. 1 is a perspective view of a gumball machine according to the present invention.
Figures 2, 4:
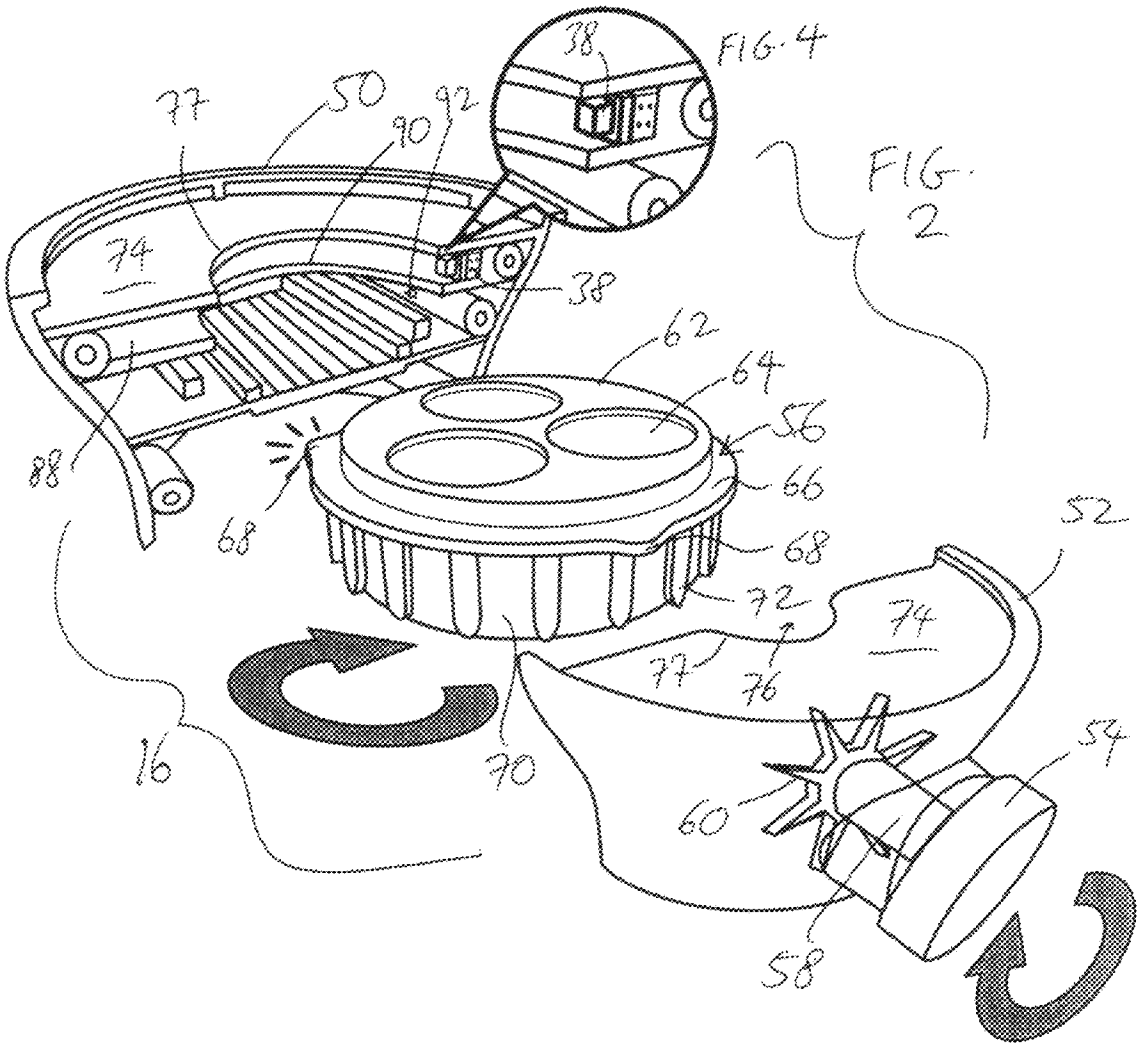
FIG. 2 is an exploded view of the neck portion of the gumball machine of FIG. 1.
FIG. 4 is an enlarged view of the switch shown in FIG. 2.
Figure 3:
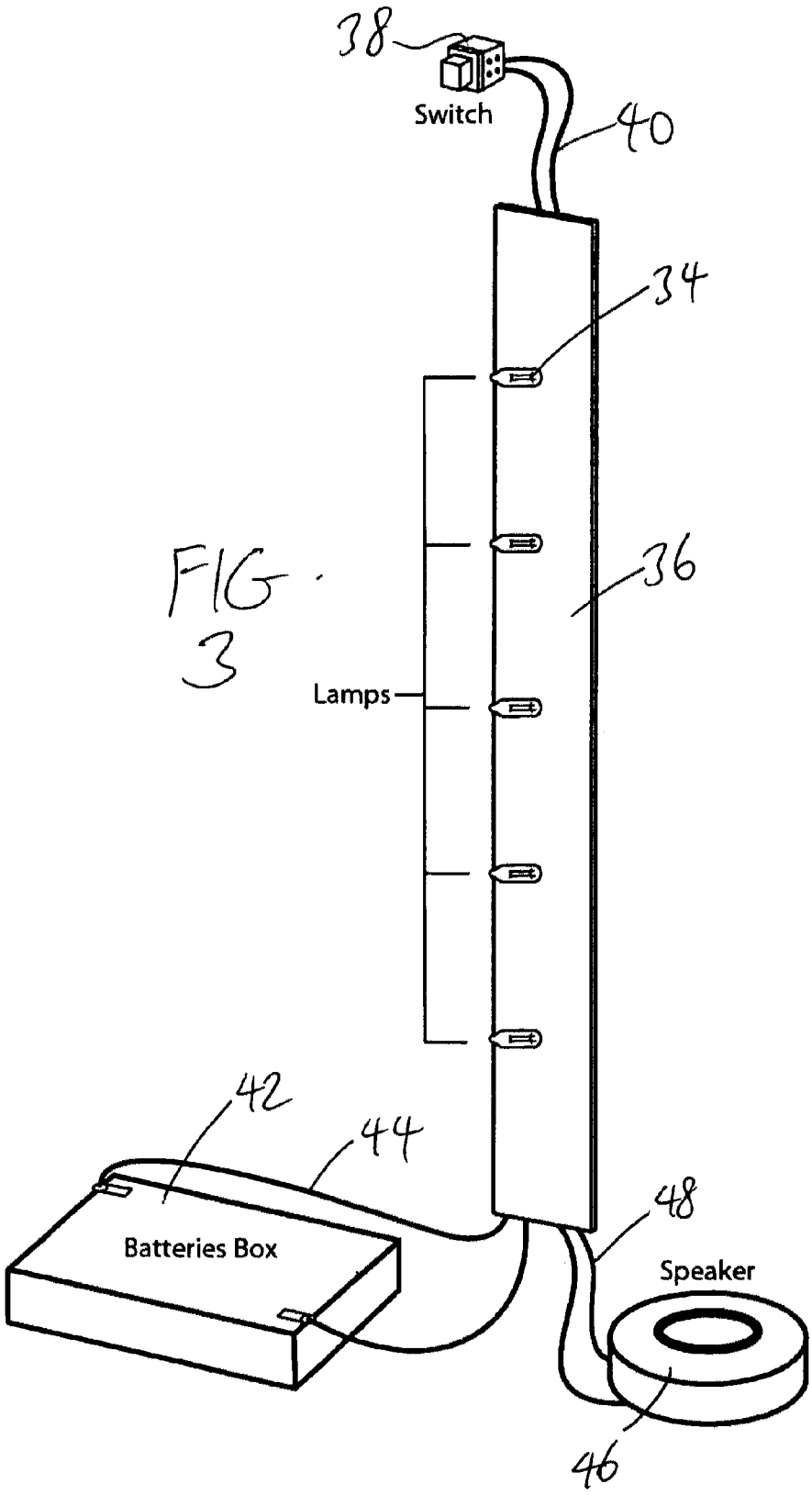
FIG. 3 is an isolated view of the electrical components of the gumball machine of FIG. 1.

Referring to FIGS. 1-3, the gumball machine 10 of the present invention has a gumball container 12, a base 14, a neck portion 16 secured to the bottom of the gumball container 12, and a transparent cylindrical support housing 18 positioned between the neck portion 16 and the base 14.

The gumball container 12 has a spherical housing 20 that can be made of a transparent material, such as plastic. Gumballs are stored in the container 12. Even though the housing 20 is shown as being spherical in configuration, it can be provided in any desired shape or size, and can even be configured as an object (e.g., an animal, a cup, etc.). The neck portion 16 is secured to the gumball container 12, and includes a switch and gumball dispensing assembly that will be described below in connection with FIG. 2. The housing 18 is cylindrical and transparent, has its upper end secured to the bottom portion of the shell portions 50 and 52 of the neck portion 16, and has its lower end secured to the base 14. The base 14 has an enlarged bottom section 30 that is adapted to be seated on the ground or a flat surface. The base 14 has a body 32 extending from the bottom section 30, and the body 32 can be provided in any desired configuration, such as in the curved stepped configuration shown in FIG. 1.

An electrical system is housed inside the housing 18 and the base 14. Referring to FIG. 3, a plurality of lighting elements 34 are provided in the housing 18. The lighting elements 34 can be LED lamps that emit different colors, and can be arranged in any manner inside the housing 18. For example, as shown in FIGS. 1 and 3, the lighting elements 34 can be arranged in series on an electrical strip 36 that extends from the top of the housing 18 to the bottom of the housing 18. A switch 38 is connected by first wires 40 to the top of the electrical strip 36. A power supply (e.g., battery box) 42 is connected by second wires 44 to the bottom of the electrical strip 36. A speaker 46 is connected by third wires 48 to the bottom of the electrical strip 36. The power supply 42 and the speaker 46 are housed inside the base 14. When the switch 38 is actuated (as described below), the lighting elements 34 and speaker 46 are turned on to create a flashing light display accompanied by selected sounds and/or music. The power supply 42 can be accessed via the bottom of the base 14 as is well-known in the art.

Referring now to FIGS. 1 and 2, the neck portion 16 has two shell portions 50 and 52 that enclose the components of the switch and gumball dispensing assembly, which includes a knob 54 coupled to a rotating platform 56. The knob 54 extends outside the shell portion 52 via a shaft 58 that extends through an opening, with a gear 60 carried on the inner end of the shaft 58. The platform 56 has a top plate 62 with three receiving openings 64 provided in the top plate 62. A skirt 66 surrounds the top plate 62, with a plurality of bumps 68 spaced-apart along the skirt 66. An annular platform base 70 is provided below the skirt 66, with a plurality of ridges 72 spaced-apart along the annular platform base 70. Each shell portion 50, 52 has a top wall portion 74 that is shaped so that a circular opening 76 is defined by inner edges 77 when the two top wall portions 74 are fitted together. Each shell portion 50, 52 also has a shelf 88 that is shaped so that another circular opening 92 is defined by inner edges 90 when the two top wall portions 74 are fitted together. The opening 92 is larger than the opening 76, and the opening 92 is sized and configured to allow the platform base 70 to be fitted therein, and to rotate inside the opening 92. The switch 38 is secured to one of the shells 50 adjacent to, and just underneath, the top wall portion 74.

The platform 56 is fitted and arranged inside the shell portions 50, 52 in a manner that allows it to rotate, and also with the skirt 66 positioned on the shelves 88 so that it is aligned at the same vertical level as the switch 38. The platform 56 is also positioned slightly off-center inside the shell portions 50, 52 (as best seen in FIG. 2). The gear 60 is aligned so that its teeth can engage the ridges 72 along the annular platform base 70.

Figure 5:
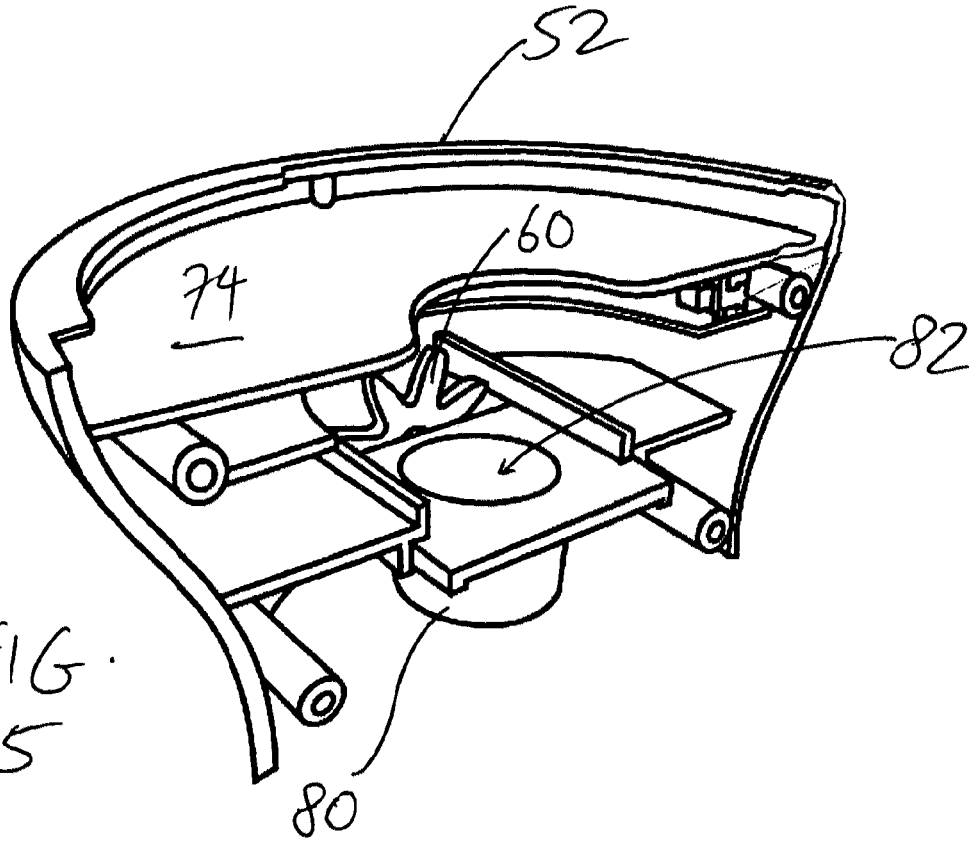
FIG. 5 is an isolated view of one shell of the neck portion shown in FIG. 2.

In operation, when the knob 54 is turned, the gear 60 rotates, with the teeth of the gear 60 engaging the ridges 72 causing the platform 56 to rotate. As the platform 56 rotates, two events occur: (i) a bump 68 will actuate the switch 38, closing the circuit and causing the lighting elements 34 to flash and the speaker 46 to broadcast music and/or sounds; and (ii) one of the openings 64 will become aligned with the opening 76 in the top wall portion 74 (this alignment is due to the fact that the platform 56 is offcenter inside the shell portions 50, 52). When the openings 64 and 76 become aligned, gravity will cause a gumball to pass through the openings 76 and 64 (in that order), and then travel down a delivery tube 80 (see FIG. 5) secured in the shell portion 52. The mouth 82 of the delivery ramp 80 is positioned offcenter in the neck portion 16 below the top plate 62. The delivery tube 80 is connected to a spiral ramp 82 that extends around the outer surface of the wall of the housing 18. The spiral ramp 82 begins at the location of the delivery tube 80 adjacent the neck portion 16, and terminates adjacent the base 14. As a result, the gumball will travel in a spiral path down the delivery ramp 80 and the spiral ramp 82. When the user wishes to dispense another gumball, he or she can turn the knob 54 again.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A gumball machine, comprising:

a gumball container that contains a plurality of gumballs;

a neck portion coupled to the gumball container, the neck portion having a switch and gumball dispensing assembly that includes an actuator that is operatively coupled to a switch;

an elongated transparent housing having an upper end coupled to the neck portion, and a lower end, the housing having therein an electrical strip that extends vertically within the housing, the switch electrically coupled to the electrical strip;

a base coupled to the lower end of the elongated housing and having a bottom portion that is seated on a surface;

a speaker positioned inside the base and electrically coupled to the switch via the electrical strip to produce sound when the switch is turned on;

a plurality of lighting elements arranged in series along the electrical strip and electrically coupled to the switch to produce flashing light when the switch is turned on; and a power supply housed inside the base and electrically coupled to the switch, the speaker and the lighting elements via the electrical strip;

wherein the actuator is a knob, and the switch and gumball dispensing assembly comprises a gear coupled to the knob, and a rotating platform that has a circumferential skirt, with a bump provided on the edge of the skirt, such that turning of the knob causes the gear to engage a portion of the platform to rotate the platform, and rotation of the platform causes the bump to engage the switch to turn on the switch, which also causes a gumball to be dispensed from the gumball container, such that flashing lights and sound are produced simultaneously as a gumball is being dispensed.

2. The machine of claim 1, further including a spiral ramp connected around the transparent housing for allowing a dispensed gumball to roll downwardly.

3. The machine of claim 1, wherein the platform further includes an opening that is aligned with the gumball container to allow a gumball to fall through the opening.

4. The machine of claim 1, further including a spiral ramp connected around the transparent housing for allowing a dispensed gumball to roll downwardly, and wherein the platform further includes an opening that is aligned with the gumball container to allow a gumball to fall through the opening and to the spiral ramp.

5. The machine of claim 1, wherein the neck portion further includes a shelf which supports the skirt of the platform thereon, the shelf being positioned at the same vertical level as the switch so that the bump on the skirt is aligned at the same vertical level as the switch.

* * * * *